US006239337B1

(12) United States Patent
Stein

(10) Patent No.: US 6,239,337 B1
(45) **Date of Patent: *May 29, 2001**

(54) ADJUSTABLE SHOULDER REST FOR A STRINGED INSTRUMENT

(76) Inventor: Karen Stein, 35 W. 90th St., New York, NY (US) 10024

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/119,086

(22) Filed: Jul. 20, 1998

Related U.S. Application Data

(60) Provisional application No. 60/053,816, filed on Jul. 25, 1997.

(51) Int. Cl.[7] ..... G10D 1/02

(52) U.S. Cl. ..... 84/279; 84/280

(58) Field of Search ..... 84/279–281

(56) References Cited

U.S. PATENT DOCUMENTS

| | | | | |
|---|---|---|---|---|
| 2,489,321 | * | 11/1949 | Nyhagen | 84/280 |
| 5,377,573 | * | 1/1995 | Tretick | 84/280 |
| 5,883,315 | * | 3/1999 | Kaplan et al. | 84/279 |

* cited by examiner

*Primary Examiner*—Robert E. Nappi
*Assistant Examiner*—Marlon T. Fletcher
(74) *Attorney, Agent, or Firm*—Evelyn M. Sommer

(57) ABSTRACT

This invention relates to an improved shoulder rest device for a stringed musical instrument, including but not limited to, violin and viola. The base pad of the shoulder rest according to the present invention is secured at one end to the chinrest of the instrument by means of two chinrest loops. The other end of the base pad is secured to the back of the instrument by means of a larger, preferably elastic, loop which has a detachable end and which goes over the shoulder junction under the fingerboard and reattaches to the base pad. A pocket part has one lateral side containing hook and loop flaps for inserting foam inserts of various sizes and shapes and a hook and loop strip on the top side to attach it to the base pad at any position.

8 Claims, 2 Drawing Sheets

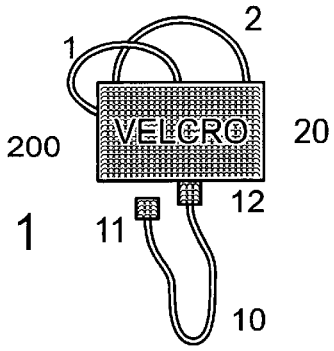
Fig. 1
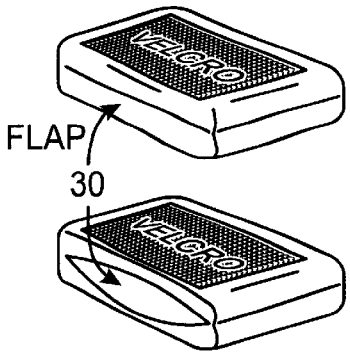
Fig. 2
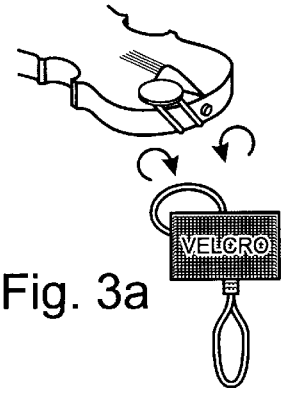
Fig. 3a
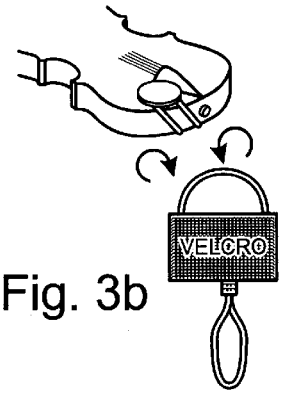
Fig. 3b
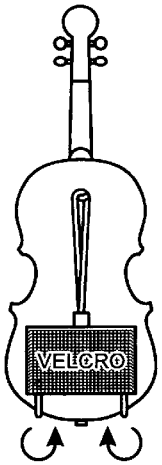
Fig. 3c
Fig. 4a
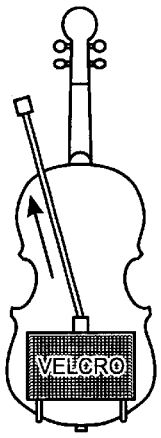
Fig. 4b
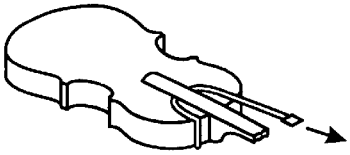
Fig. 4c
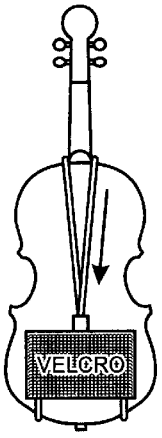
Fig. 6a
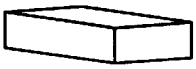
Fig. 6b
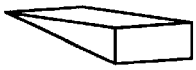
Fig. 6c
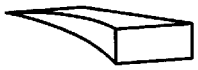
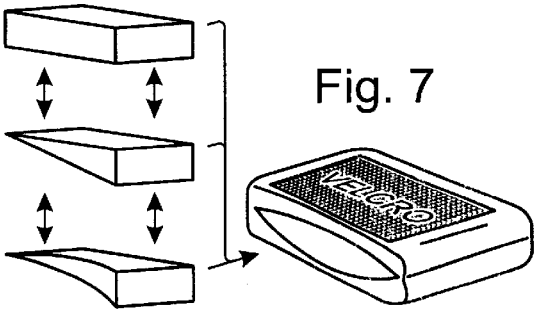
Fig. 7
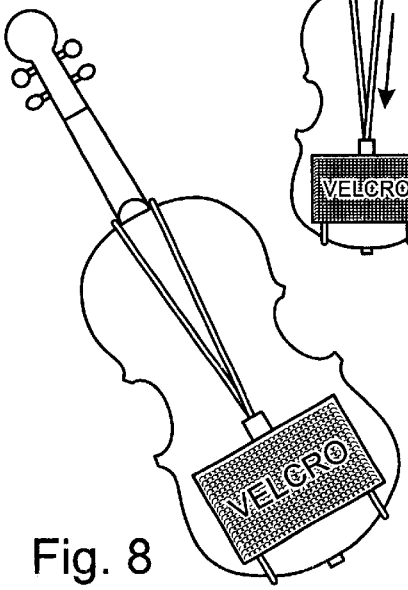
Fig. 8

ADJUSTABLE SHOULDER REST FOR A STRINGED INSTRUMENT

CROSS-REFERENCE TO RELATED APPLICATION

This application is based on and claims priority from U.S. Provisional Patent Application Ser. No. 60/053,816 filed Jul. 25, 1997, which is herein incorporated by reference.

FIELD OF THE INVENTION

This invention relates to an adjustable, light-weight, and economical shoulder rest device for use when playing string instruments such as a violin or a viola.

BACKGROUND OF THE INVENTION

This invention relates to an improved shoulder rest for a stringed instrument, including but not limited to, violin or viola. Shoulder rest devices are used for support and cushioning between the back of the string instrument and the player's shoulder while the instrument is being played. The shoulder rest disclosed in the present invention is designed specifically to give each player the ability to easily customize his or her own rest. It is made in several sizes to fit instruments of any size, and can comfortably accommodate the individual physical dimensions of any player as well as the way each player holds the instrument. Simple to use, it is completely height- and angle-adjustable and conforms to the contour of each individual's body. Its attachment is completely stable yet allows for placement in different positions on the instrument, and is easy to take on and off.

In particular, the shoulder rest is removably mounted lengthwise to the stringed musical instrument by means of two elastic loops. The detachable end of one loop is looped over the shoulder junction and under the fingerboard to be reattached at the origin by means of a hook and loop material, such as Velcro(TM), tab. The other fixed loop goes around the chinrest. The use of an elastic or stretchable member permits the shoulder rest of the present invention to be mounted on stringed instruments lengthwise. This unique lengthwise attachment counters the side to side pulls which occur when one plays, resulting in stability. An adjustable, multiposition pocket enables the shoulder rest to fit any individual player, regardless of the specific physical dimensions of the player, such as neck length or configuration of shoulders, and the particular way the individual holds the instrument.

Shoulder rests have been used in the prior art to promote comfort to the player while the instrument is played, and to provide support to the instrument to facilitate playing. The shoulder rest is usually secured to the back of the violin or other stringed instrument to provide a surface which rests on the player's shoulder.

Prior art shoulder rests have frequently provided for a fixed securement of the device to a single, predetermined spot along the back of the string instrument, by means of devices such as clamp plates, clamping forks, mounting plates, screws, pivots, and the like. For example, U.S. Pat. No. 5,567,893 discloses a shoulder rest which is attached to the instrument by means of clamping members, pedestals, and springs. U.S. Pat. No. 3,727,509 discloses a shoulder rest which is secured by means of the clamp plate of a conventional chin rest. In the shoulder rest disclosed in U.S. Pat. No. 5,208,409, the support piece is rigidly attached by means of clamping pieces to a rigid arm which is fastened to the base of the chinrest. These rigidly secured shoulder rests usually contain some type of adjustment means for varying the spacing and the inclination between the shoulder rest and the back of the instrument.

Such rigidly affixed shoulder rests, however, can be located only in relatively few positions along the back of the instrument. They also offer a relatively small range of possible height and angle adjustment. The player is thereby deprived of the possibility of choosing the position of the shoulder rest at the back of the instrument which would provide optimal comfort for his or her specific physical characteristics and for choosing the exact height and angle. Therefore, the player must usually compromise his or her comfort.

Shoulder rests which are rigidly secured to an instrument have other serious drawbacks. For example, most rigidly affixed shoulder rests engage a substantial portion of the underside of the instrument. This causes the sound emanating from the instrument to be absorbed and muffled to some degree. Rigid mounting structures for shoulder rests thereby adversely affect the tonal quality and resonance of the instrument. Another drawback of rigid mounting structures is the potential for the slippage and falling off of screws or plates or the like. They can also damage the surface finish of the instrument. Further, rigid shoulder rests can create pressure points where they contact the player's body.

It is therefore an object of the current invention to provide a new design for a shoulder rest, which is formulated specifically to give each player the ability to easily customize his or her own rest.

It is another object of this invention to provide a shoulder rest for a string instrument which can be placed at any position on the instrument desired by the player for optimal comfort.

It is another object of this invention to provide a shoulder rest which has a completely stable attachment, and yet is easy to take on and off It is a further object of this invention to provide a shoulder rest which is capable of being attached to and removed from a stringed musical instrument without the use of metal clamps and screws or the like which may mar the surface of the instrument, and which are likely to interfere with the proper vibrations of the sounding boards or resonating chamber of the instrument, thereby adversely affecting the tonal quality of the instrument.

It is further object of this invention to provide a shoulder rest which can be fitted with foam inserts of the desired size or that can be adjusted to the desired size, and thereby is completely height- and angle-adjustable, while conforming to the contour of each individual player's body, providing a lightweight but broad base of support and eliminating pressure points.

It is a further object of this invention to provide a shoulder rest for a stringed instrument which attaches lengthwise to counter the natural sideways pulls which occur while playing, providing stability. This is accomplished by means of stretchable elastic loops which go (1) over the shoulder junction and under the fingerboard of an instrument to reattach at the base by means of a hook and loop material tab and (2) over the chinrest.

SUMMARY OF THE INVENTION

The above mentioned objectives are attained by this invention which discloses an adjustable shoulder rest comprising (1) a base pad, the underside of which is made of a fabric such as ultrasuede, the upperside of which is made of at least in part of hook and loop material such as Velcro (TM); (2) two fixed elastic chinrest loops, which are sewn to one lateral side of the base pad; (3) a longer loop terminating in a stationary hook and loop tab at one end and detachable at the other end, the detachable end going over the shoulder junction under the fingerboard to reattach at the stationary tab; (4) an adjustable pocket made of a fabric such as ultrasuede with hook and loop material on one side which attaches the adjustable pocket to the base pad, and an opening hook and loop material flap on one lateral side into which foam inserts can be placed; and (5) foam inserts of various shapes, sizes and heights, including straight inserts, lateral and contour wedges.

The foam inserts offer firm support, while at the same time conform to the player's body eliminating pressure points. Moreover, the foam inserts offer a broad base of support across the player's body.

The shapes of the foam inserts are designed to give the player several ways to adjust the instrument in relation to his/her body. The straight cut foams allow for change in height of the shoulder rest. The lateral wedges will tilt and change the angle of the instrument from side to side. Finally, the contour wedges will accommodate and level the slope of the shoulder, changing the lengthwise angle of the instrument. As various sizes of these shapes are included, the player has the option of using the inserts singly or in any combination, resulting in a multitude of possibilities and a wide range of adjustability.

The ability to adjust the instrument via the foam inserts in the adjustable pocket as described above coupled with the ability to place the pocket anywhere on the instrument via the stable base pad with attached elastic loops give the player almost unlimited control and a custom fit.

BRIEF DESCRIPTION OF THE DRAWINGS

The present invention will be understood and appreciated more fully from the following detailed description, taken in conjunction with the accompanying drawings in which:

FIG. 1 is a plan view of the shoulder rest base pad of the present invention, showing the two chinrest loops attached at one lateral side of the pad, and a longer loop with one detachable end at another lateral side of the pad.

FIG. 2 is a perspective view of the adjustable pocket, showing the hook and loop material flap at one lateral side of the pad, and the hook and loop fabric at the upper side of the pad.

FIG. 3 shows the attachment of the base pad via the choice of chinrest loops.

FIG. 3(*a*) shows the comer loop which will attach to a chinrest with the clamp to the left of the tailpiece.

FIG. 3(*b*) shows the end loop which will attach to a chinrest with a clamp over the tailpiece.

FIG. 3(*c*) shows the base pad brought around to the back of the instrument by stretching one of the chinrest loops already attached.

FIG. 4 shows the attachment of the base pad to the back of a violin via a detachable elastic loop.

FIG. 4(*a*) shows the elastic loop going up the back of the violin, 4(*b*) under the fingerboard, and 4(*c*) returning down the back to reattach at the tab.

FIG. 6(*a*) shows the straight foam inserts, which can be of various lengths, widths, and heights.

FIG. 6(*b*) shows foam inserts in the shape of lateral wedges which can be of various sizes.

FIG. 6(*c*) shows foam inserts in the shape of contour wedges, which also can be of various sizes.

FIG. 7 shows how the foam inserts can be placed in the adjustable pocket.

FIG. 8 shows the base pad attached to the adjustable pocket attached on the back of a violin.

DETAILED DESCRIPTION OF THE PREFERRED EMBODIMENT

Figure 5:
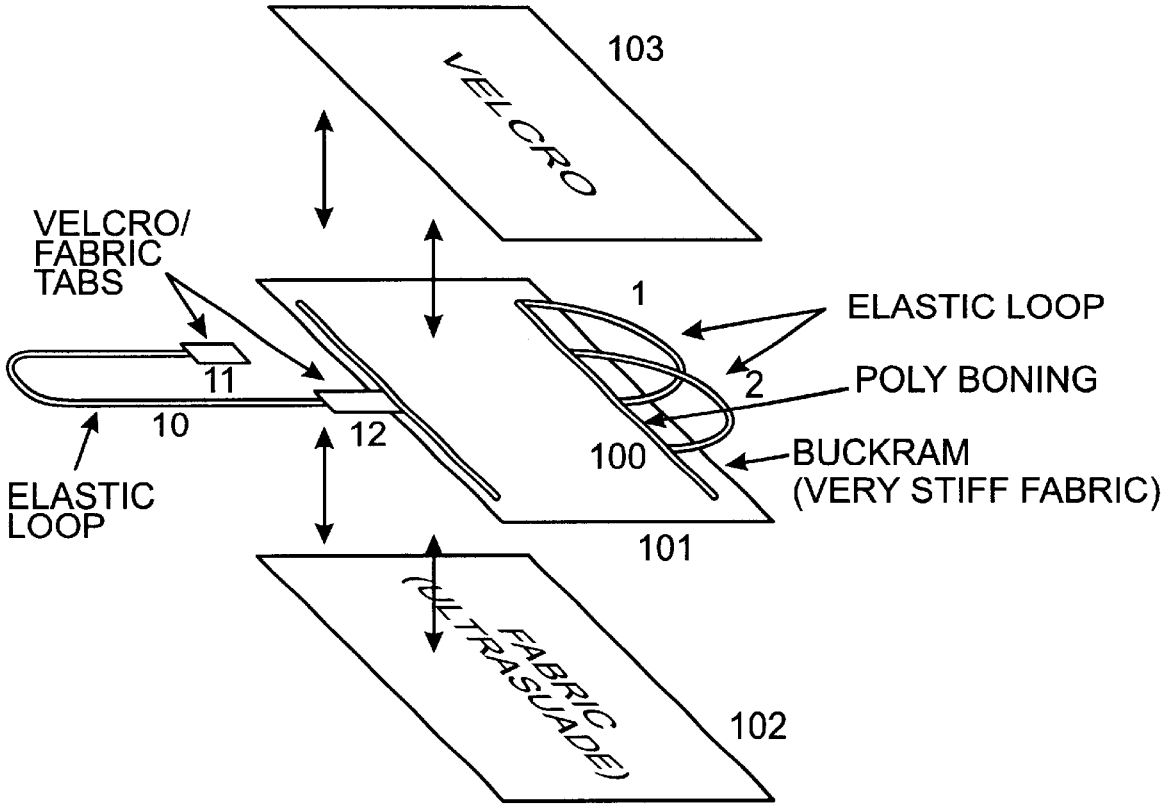
FIG. 5 shows the internal construction of the base pad.

By way of example, the present invention is illustrated in terms of one possible manner of constructing a shoulder rest according to the design of this invention. The following examples are provided for the purpose of aiding in explaining the present invention, and the invention's applications should not be limited to the particular examples described herein.

FIG. 1 shows a plan view of the base pad and attached loops of the shoulder rest. The base pad 200 has an upperside 20 made of hook and loop material. The underside is made of ultrasuede. The two elastic chinrest loops corner loop 1 and end loop 2 are attached to one end of the base pad 200, and serve the function of securing the base pad 200 to the chinrest of the instrument. A longer elastic loop 10 is attached to the other end of the base pad 200 by means of a stationary hook and loop tab 12 at a first end 13 of elastic loop 10. The other end 14 of the elastic loop 10 is detachable, and also consists of a hook and loop tab 11. Tabs 11 and 12 each form a mating side of the hook and loop adhesive and may be secured to each other.

FIG. 3 shows the chinrest loops 1 and 2 as they attach. The corner loop 1 will accommodate a chinrest 31 that clamps on the instrument to the left of the tailpiece 32. (FIG. 3(*a*)). The end loop 2 will accommodate a chinrest 31 that clamps on the instrument over the tailpiece 32. (FIG. 3(*b*)). The base pad 200 is then stretched to the back 33 of the instrument. (FIG. 3(*c*)).

The longer elastic loop 10 is designed to go around over the shoulder junction 42 under the fingerboard 41, the n to reattach at the stationary end by means of the hook and loop tabs 11 and 12. FIG. 4(*a*) shows the back 33 of the violin with one end of the longer elastic loop 10 yet unattached. FIG. 4(*b*) shows the longer elastic loop 10 going under the fingerboard 41. FIG. 4(*c*) shows the back 33 of the violin, displaying how the longer loop 10 returns to reattach at tab 12.

FIG. 2 shows a perspective view of the invention, and illustrates the configuration of the adjustable pocket part 21 of the invention. A hook and loop flap 30 is in one of the lateral sides of the adjustable pocket 21. Foam inserts of various sizes and shapes (71, 72 and 73) can be inserted through the hook and loop flap 30 and into pocket 21, as shown in FIG. 7. The top of pocket 21 has a wide strip of hook and loop material 201 corresponding to hook and loop material 20 on base pad 200 allowing the pocket part 21 to be adjustably attached to base pad 200 on the back of the instrument, thereby allowing the player the ability to customize the shoulder rest.

The internal construction of the base pad 200 can be appreciated from FIG. 5. Two elastic loops 1 and 2 are attached to one side of the base pad 200, for purposes of securing the pad to the chinrest 31 of the instrument. The elastic loops 1 and 2 are sewn to a stiff Buckram fabric 101 and to poly-boning 100 for strength and stability. At the other end of the base pad, the stationary hook and loop tab end 12 of the large elastic loop 10 is sewn to Buckram fabric 101 and poly-boning 103. The underside 102 is preferably a soft fabric such as ultrasuede. The topside 20 is preferably made of a hook and loop material.

FIGS. 6(*a*), (*b*) and (*c*) illustrate foam inserts of various shapes and sizes which may be inserted in pocket 31. FIG. 6(*a*) shows straight foam inserts 71.

FIG. 6(*b*) shows foam inserts in the shape of lateral wedges 72. FIG. 6(*c*) shows foam inserts in the shape of contour wedges 73.

FIG. 7 shows how the foam inserts (71, 72 and 73) can be placed in the adjustable pocket 21. An individual player can customize the shoulder rest of the present invention to best fit his or her needs, by selecting the foam insert or inserts which have the size and shape providing optimal support and comfort and inserting them into pocket 21 through the hook and loop flap 30. It is also possible to customize the foam inserts by, for example, cutting them to a smaller size or different shape.

FIG. 8 shows the base pad 200 with adjustable pocket 21 attached on the back 33 of a violin. Because the shoulder rest is secured lengthwise by means of elastic and stretchable loops, the shoulder rest is easy to take on and off, yet stable. The adjustable pocket can also be positioned anywhere on the base pad on the back of the instrument for maximum comfort and support, regardless of the particular neck and shoulder configuration of the player, and of the individual way the player holds the instrument.

The above embodiment is provided only for the purpose of explaining a specific application of the present invention, and it will be appreciated by those skilled in the art that the applicant's invention is not limited to what has been particularly shown and described herein above. For example, inserts of material other than foam may be used. Likewise, re-attachable means other than hook and loop material may be used to secure the adjustable pocket to the base pad, the pocket flap and the elastic loop that goes around the fingerboard. For example, buttons, buckles or the like could serve as re-attachable tabs, etc. Also, materials other than elastic can be looped around the chinrest and neck. A non-stretchable strap or pair of straps and buckle which allows the strap(s) to be tightened could be substituted for the elastic long loop. More over, fixed length non-stretchable straps could be substituted for elastic materials in the chinrest loops. It will be apparent to those skilled in the art that various modifications and variations could be made in the present invention without departing from the scope or spirit of the invention.

What is claimed is:

1. A shoulder rest for a stringed musical instrument having a chin rest, a shoulder junction and a finger board, said shoulder rest comprising:

a base pad made of non-rigid material having a first lateral side and a second lateral side;

a pocket part made of non-rigid material adapted for accepting inserts of foam or other padding material of various shapes and sizes for customizing said shoulder rest, said pocket part and base pad each being provided with a strip or layer of hook and loop type fastener, whereby said pocket part may be adjustably positioned and releasably attached with respect to said base pad;

a chin rest loop attached to said first lateral side of said base pad, said chin rest loop being dimensioned for looping over said musical instrument proximate to said chin rest;

a second loop attached to said second lateral side of said base pad, said second loop being dimensioned to go over the shoulder junction, under the finger board and being releasably attached at its origin securing said base pad to said instrument, the arrangement of said chin rest loop and said second loop permitting the lengthwise mounting of said shoulder rest on said instrument.

2. The shoulder rest of claim 1 further comprising inserts of foam or other padding material inserted in said pocket part.

3. The shoulder rest of claim 1 wherein said pocket part further comprises a flap provided with a strip of hook and loop type fastener, for releasably securing said flap to a corresponding strip of hook and loop type fastener, provided on said pocket part following insertion of said inserts through said flap into said pocket part.

4. The shoulder rest of claim 1 wherein said second loop is an elastic loop have a detachable end and a stationary end, said detachable end being looped over said shoulder junction, under said finger board and attached to said stationary end.

5. The shoulder rest of claim 4 wherein said stationary end and said detachable end of said second loop are each provided with a strip of hook and loop type fastener, for releasably securing said ends.

6. The shoulder rest of claim 2 wherein said inserts are made of foam.

7. The shoulder rest of claim 6 wherein said foam inserts comprise a combination of straight, wedge and contour shapes.

8. The shoulder rest of claim 1 wherein the underside of said base pad is made of soft fabric.

* * * * *

UNITED STATES PATENT AND TRADEMARK OFFICE

CERTIFICATE OF CORRECTION

PATENT NO. : 6,239,337 B1 
DATED : May 29, 2001
INVENTOR(S) : Stein, Karen

It is certified that error appears in the above-identified patent and that said Letters Patent is hereby corrected as shown below:

Drawings,

Please substitute the following corrected drawings for Figs. 1, 2, 3a, 3b, 3c, 4a, 4b, 4c, 5, 6a, 6b, 6c, 7 and 8.

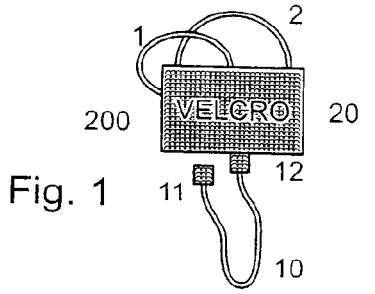

Fig. 1

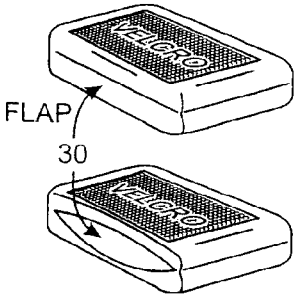

Fig. 2

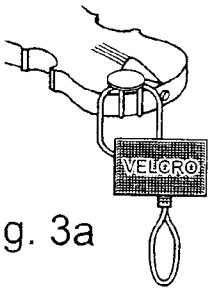

Fig. 3a

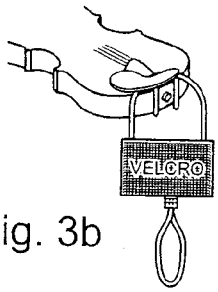

Fig. 3b

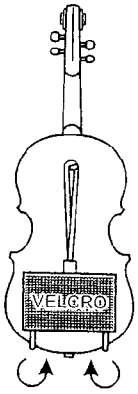

Fig. 3c

UNITED STATES PATENT AND TRADEMARK OFFICE

CERTIFICATE OF CORRECTION

PATENT NO. : 6,239,337 B1 
DATED : May 29, 2001
INVENTOR(S) : Stein, Karen

It is certified that error appears in the above-identified patent and that said Letters Patent is hereby corrected as shown below:

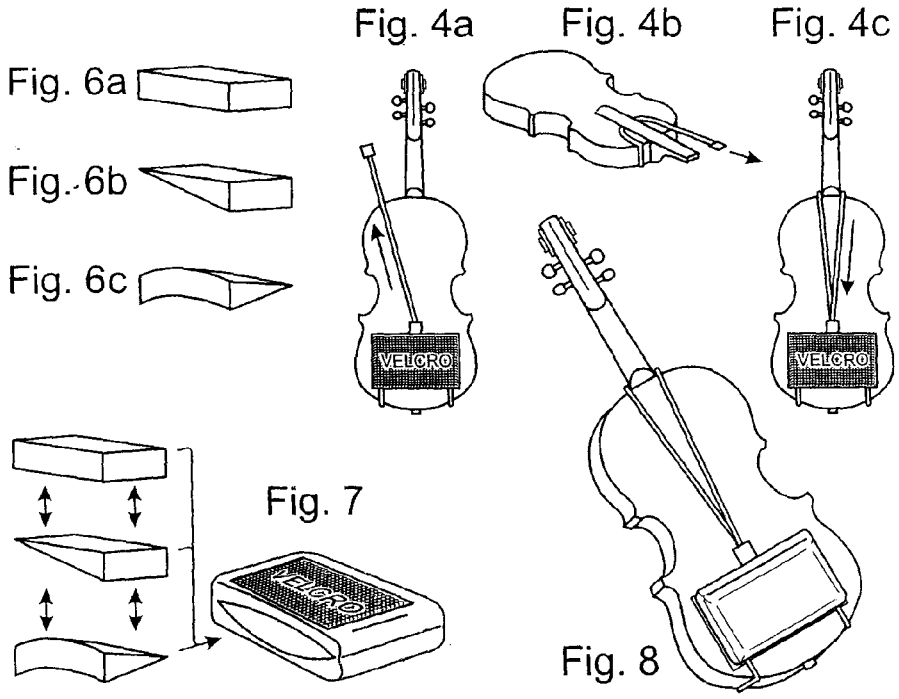

UNITED STATES PATENT AND TRADEMARK OFFICE

CERTIFICATE OF CORRECTION

PATENT NO. : 6,239,337 B1 
DATED : May 29, 2001
INVENTOR(S) : Stein, Karen

It is certified that error appears in the above-identified patent and that said Letters Patent is hereby corrected as shown below:

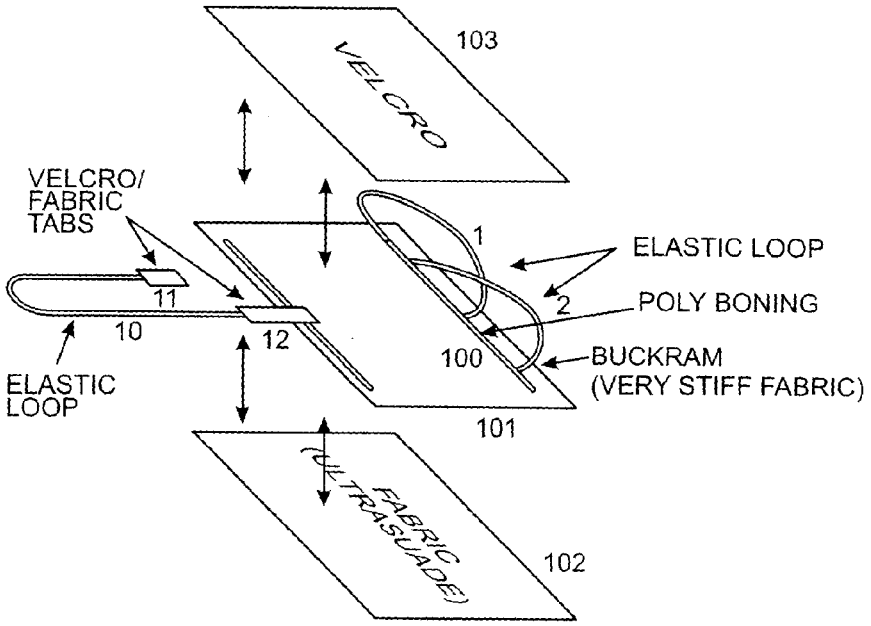

Fig. 5

Signed and Sealed this

Twenty-fifth Day of June, 2002

*Attest:*

*Attesting Officer*

JAMES E. ROGAN
*Director of the United States Patent and Trademark Office*